US007497023B1

(12) United States Patent
Simmons et al.

(10) Patent No.: US 7,497,023 B1
(45) Date of Patent: Mar. 3, 2009

(54) OFFSET LINE ALIGNMENT TOOL

(76) Inventors: Gary L. Simmons, W7207 Heram Rd., Holmen, WI (US) 54636; Brian D. Simmons, W7207 Heram Rd., Holmen, WI (US) 54636

( * ) Notice: Subject to any disclaimer, the term of this patent is extended or adjusted under 35 U.S.C. 154(b) by 0 days.

(21) Appl. No.: 11/801,544

(22) Filed: May 10, 2007

(51) Int. Cl.
*B43L 13/00* (2006.01)
*G01C 15/10* (2006.01)

(52) U.S. Cl. ..... 33/413; 33/407; 33/1 LE

(58) Field of Classification Search ..... 33/413, 33/404, 407, 408, 409, 756, 1 LE
See application file for complete search history.

(56) References Cited

U.S. PATENT DOCUMENTS 1,080,836 A * 12/1913 Lake ..... 33/409
2,505,606 A * 4/1950 Coffey ..... 33/409
2,623,290 A * 12/1952 Kampel ..... 33/409
2,809,434 A * 10/1957 Cordier ..... 33/407
3,122,836 A 3/1964 Aciego
3,555,688 A * 1/1971 Smathers ..... 33/408
4,231,156 A 11/1980 Cooper
4,561,189 A * 12/1985 Hirneise ..... 33/408
5,009,015 A 4/1991 Redl
6,036,133 A 3/2000 Milligan
6,360,445 B1 3/2002 Haas
6,421,926 B1 7/2002 Cappuccio
6,430,826 B1 * 8/2002 Sigl ..... 33/408
7,320,181 B2 * 1/2008 Charpentier ..... 33/407

* cited by examiner

*Primary Examiner*—Christopher W Fulton
(74) *Attorney, Agent, or Firm*—M. Paul Hendrickson

(57) ABSTRACT

The present invention provides a durable offset straight line alignment tool which includes a rigid body having graduated guide lines for stringing offset lines at a construction site. The tool may also include a flat base surface and nailing apertures for nailing the tool to an offset mount at the desired anchoring site and a leveraging catch for a leveraging instrument such as a claw of a claw hammer to easily remove the anchored tool from the anchoring site.

10 Claims, 5 Drawing Sheets

OFFSET LINE ALIGNMENT TOOL

FIELD OF INVENTION

The present invention relates to an alignment tool and more particularly to an offset line alignment tool and its use.

BACKGROUND OF THE INVENTION

In the building construction laterally disposed wood blocks of a desired thickness are customarily used to establish an offset string line so as to provide a demarcation line for the placement of work materials in the construction of a building.

Customarily, the workmen at the construction site will nail a scrap wood piece of a desired thickness to the structure or at an offset demarcation site (e.g. a pair of vertical posts) properly aligned to provide the appropriate offset demarcation reference point. Most typically, a scrap wood block of a ¾ inch or 1½ inch thickness serves as measurement from the offset line for the placement of work materials upon the structure.

Unfortunately, the use of wood blocks as an offset line mount contributes to increased construction costs, decreased offset line settings reliability and significantly increased working hazards. In order to insure the accuracy of the offset line, the site workers customarily take time to seek or fabricate a suitable wood block free from warp, cracks, knots, grooves or cuts, dimensional undersizing or oversizing, etc., for nailing onto the offset anchoring site. Upon nailing, the nailed wood block becomes a work place hazard and especially after the nailed block has been later removed from its anchoring site. In order to remove the nailed block from the site, the nailed block is customarily pried loose from its anchoring site. Unfortunately, the projecting and exposed nail tip will typically remain firmly anchored onto the wood block, thus creating a hazardous working environment. This can lead to worker injury or death at the work site. The hazards presented by nails projecting from used lumber pieces at the work site has prompted OSHA to issue regulations and fines for failing to remove hazardous nails from scrap lumber at the construction site. This necessitates the site workers to exercise particular care and effort to remove all nails from offset boards used in the offset string lines. The time devoted to removing nails from the wood blocks reduces productive work at the construction site.

Although there has long existed a need for a more effective tool for offset systems in the construction business, the offset line alignment gear and use has remained essentially the same as it existed a century ago. An alignment tool of a durable structure suitable for prolonged and continuous use, easily removable after use, convenient in anchoring and the aligning the tool at the construction site, equipped with graduated alignment guides which affords multiple choices in offset line positioning, an improved guide for retention of the string line during use and a tool sized so as to be easily pocketed and carried by workmen at the work site would afford significant advantages over past tools and practices.

SUMMARY OF THE INVENTION

The present invention provides an offset line alignment tool which significantly enhances the efficacy, safety and workmanship by workers in the construction of buildings. When two offset line alignment tools are paired together and laterally displaced apart at the appropriate offset positions, accurate and efficient alignment of the work materials upon the structure may be readily achieved. This significantly enhances productivity and work quality.

Pursuant to the present invention, there is provided an offset line alignment tool characterized as having one or more contacting or base surface sections capable of providing a substantially flat planar or measurable surface distance allowing the tool to be placed measurably upon any suitable supportive base and used to anchor or mount the tool at the appropriate offset position. The tool includes a rigid body extending upwardly from the base surface section. The rigid body includes one or more line guides for retaining an offset string line at a fixed offset alignment. In order to anchor the offset line tool to an appropriate offset site, the rigid body further includes anchor securing members such as a nail receiving aperture for anchoring the tool by nailing onto the offset site. In order to effectively remove and reuse the durable offset line alignment tool, the tool may also effectively include a leveraging catch such as a catch for a claw of a claw hammer which then allows the anchored offset line tool to be expeditiously removed for reuse from the offset site.

DETAILED DESCRIPTION OF THE INVENTION

Figure 1:
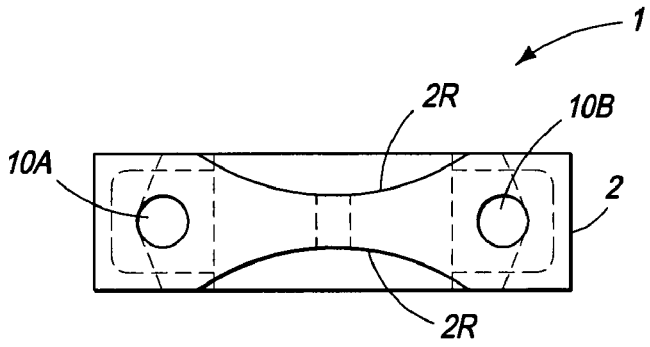
FIG. 1 is a top view of the offset line alignment tool of this invention.
Figure 2:
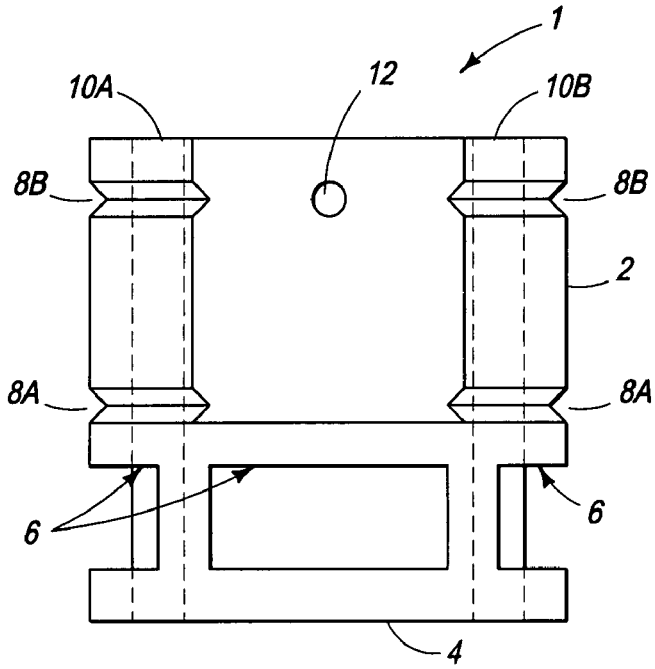
FIG. 2 is a frontal view of the offset line alignment tool shown in FIG. 1.
Figure 4:
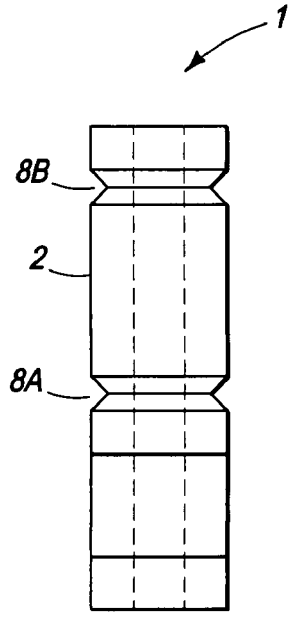
FIG. 4 is a side view of FIG. 1.
Figure 3:
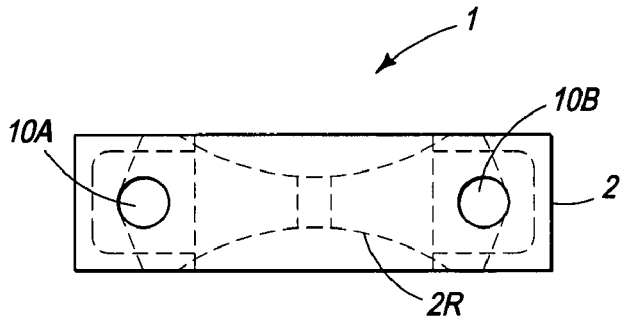
FIG. 3 is a bottom view of FIG. 1.
Figure 5:
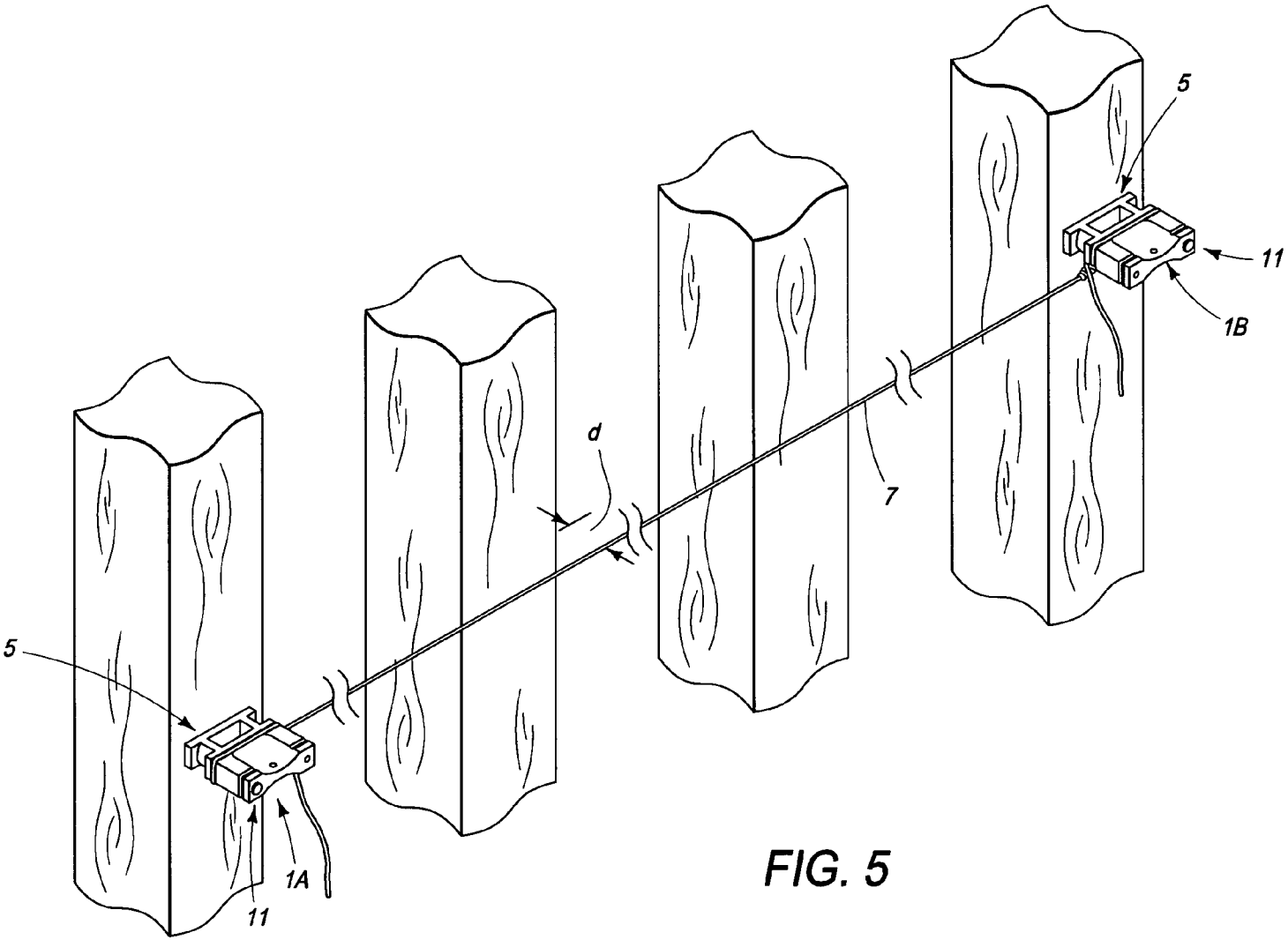
FIG. 5 is an elevated view of a pair of tools shown in FIGS. 1-4 being used to provide an offset string line between four posts.
Figure 8:
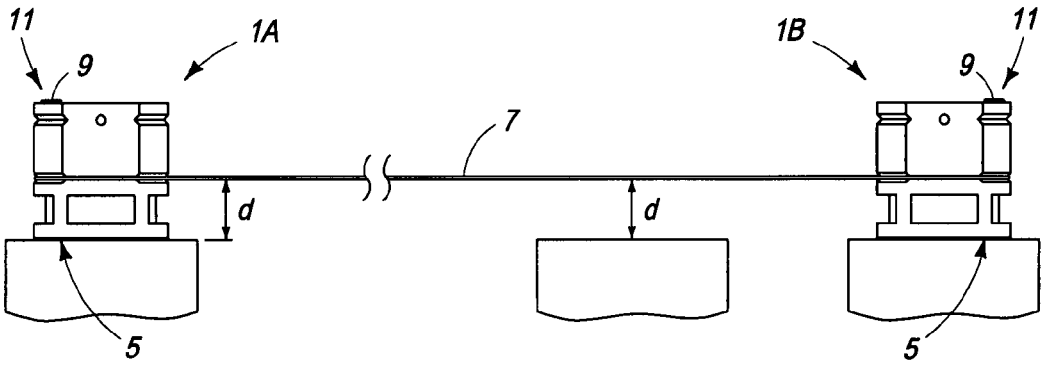
FIG. 8 depicts a horizontal offset line usage of the pair of offset alignment tools shown in FIG. 5.
Figures 9A, 9B:
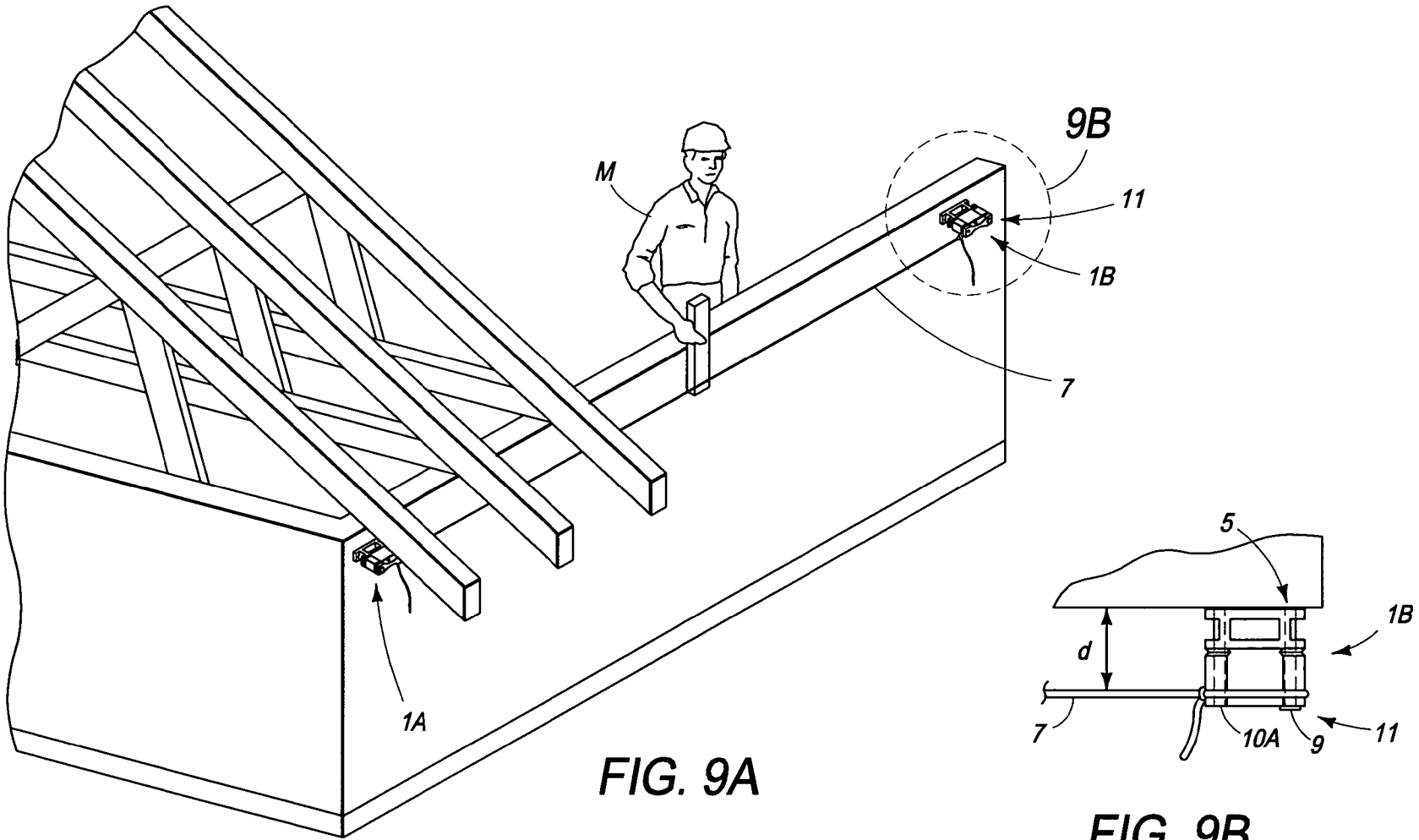
FIG. 9A depicts the use of a pair of offset alignment tools and offset string line in the placement of roof trusses upon a structure.
FIG. 9B is an enlarged view of FIG. 9A.

With reference to the drawings, there is illustrated an offset alignment tool 1 and its use in the construction of a building. The offset alignment tool 1 includes a main body 2 having a base surface section 4 for resting flatly or measurably against a desired offset construction mounting site 5 to provide the desired offset bench mark for setting an offset string line 7 which is then strung between a pair of offset alignment tools 1 as illustrated by FIGS. 5, 8, and 9A and in part by FIGS. 6 and 9B. The base surface section 4 suitably constitutes an integral part of the main body 2 of the offset tool 1 and provides (when resting against the mounting site 5) a known measurement point from a pre-measured guide 8 which is incorporated into the main body 2 as described in greater detail hereinafter. The main body 2 will most suitably be constructed of a durable and rigid material capable of withstanding the wear, tear and physical abuses normally encountered in its customary use. Accordingly, the tool 1 including its body 2 may typically be constructed of durable and rigid materials such as a metal (e.g. steel, aluminum, etc.), an impact resistant plastic (e.g. thermoset and thermoplastics), composite materials, durable hard woods and the like. Light weight and durable moldable plastics such as the moldable or machineable impact resistant thermoplastic materials as well as molded or machined light weight metals such as aluminum may be most effectively utilized for this purpose.

Illustrative of the thermoplastic materials include the dry polyamides (nylons) which can be effectively injection molded or extruded under mass production conditions. Exemplary dry polyamides include a polyamide 6 such as polyamide composition commercially identified as MC®MC901 distributed and sold by Quadrent Engineering Plastic Products, 2120 Fairmont Avenue, Reading, Pa., 19612 and most preferably ZYTEL®101NC010 (Dry), of Dupont Engineering Polymer-Polyamide 66 of 601 Pennsylvania Avenue, Suite 325, North Building, Washington, D.C. 20004, the specifications of which may be obtained from the web site at www.prospector.ides.com.

The tool may be effectively manufactured by fabricating an injection mold designed to produce an offset line alignment tool of the appropriate size and configuration as depicted by the Figures followed by injection molding therein of an appropriate injection moldable thermoplastic material such as ZYTEL®101NC010 dry polyamide 66 under the appropriate injection molding conditions to produce the desired offset alignment tool 1.

As may be further observed from the Figures (e.g. see FIGS. 2-3 and 5-9), the rigid main body 2 is provided with at least one string line guide (generally prefixed by 8) which serves as a pre-measured guide 8 for effectively retaining the string line 7 at one or more commonly used offset positions. The depicted offset alignment tool 1 is shown as having two graduated string line guides 8A & 8B which provide a desired predetermined offset position (d) from the base surface section 4 for the workmen M to use as the offset string line 7. Offset string line guides 8A & 8B, as depicted in the Figures, may be illustratively set to provide an offset string line 7 off set at about ¾ inch and 1½ inches which are commonly used as an offset string line 7 settings at the construction site. If inverted, tool 1 (which measures 1¾ inch square) would then provide guides 8 measuring ¼ inch and 1 inch. Although not shown, it should also be apparent that a single offset guide 8 when placed at an appropriate offset position with a tool 1 of an appropriate dimensional height with both flat top and flat bottom surfaces (referred both serving broadly as a base surface section 4) would provide a dual purpose guide 8 by providing two different offset line guides 8 from one offset line guide 8. For example, a tool 1 measuring 2¼ inch in height having a line guide 8 of ¾ inch from the bottom surface 4 would serve as ¾ inch guide 8 when resting upon its bottom surface 4 and alternatively serve as a 1½ inch offset guide 8 simply by inverting the tool 1 so that it rests upon its top surface 4.

The offset string line alignment tool 1 when used to establish offset string lines 7 includes anchor securing means 10 for anchoring the unanchoring securing means 10 of the tool 1 at the desired anchoring site 5 with an anchoring implement (generally prefixed by 9) such as illustrated by FIGS. 5-6 and 8-9A-B. Although a host of anchoring implements (e.g. clamps, suction cups, magnets, etc) may be used to anchor the anchor securing means 10 of the tool 1 at the offset anchoring site 5, the use of nails 9 has been found to be particularly suitable for use as an anchoring implement 9. As may be observed from the Figures, the body 2 of the tool 1 may be appropriately equipped with nailing apertures 10A & 10B (generally prefixed by 10) one of which will effectively serve as anchor securing means 10 when used in combination with the anchoring implement 9 to anchor and maintain the tool 1 and string line 7 at the desired fixed offset position (d) at the anchoring site 5. As may also be observed from FIGS. 5-6, 8, 9A and 9B, nails 9 driven through the appropriate nailing apertures 10A & 10B firmly anchor the tool 1 to the desired offset mounting site 5. As may be further observed from FIGS. 5, 6, 8, 9A and 9B, it is unnecessary to anchor the tool 1 by nailing both apertures 10A & 10B to the anchoring site 5. One nail 9, driven onto the outermost nailing aperture (e.g. 10A or 10B) of the string line 7, as illustrated, will typically provide sufficient anchoring of the tool 1 to the anchoring site 5.

The tool 1 may be appropriately designed to fulfill multiple functional purposes. The guides 8 may be established by any suitable securing means for securing the string line 7 to the tool 1 at a predetermined offset distance (d). The guide 8 will, in its most appropriate form, retain the string line 7 by mechanical means such as a grooved section, eyelet and the like incorporated into the tool body 2 at predetermined unit of measurement. Although the guide 8 may be of any dimensional size or configuration suitable for retaining the string line 7, the drawings illustrate the usefulness of the tool 1 in establishing ¾ inch and 1½ inch offset lines. Although less desirable, the anchoring nail (e.g. a double headed nail, not shown) and the dimensional size of the tool 1 may be cooperatively used to establish the guide 8 for the string line 7. For example, when resting upon its side surface and using eyelet 12 as depicted in the Figures as an anchoring aperture 10 and a double headed nail as the string line guide, the tool thickness (e.g. such as ½ inch) may accordingly be effectively used to establish the offset string line distance (d) or setting.

The height and bore of the nailing apertures 10A & 10B may also be designed so as to provide appropriate anchoring body depth and bore for a particular nail size such as a 16d nail (e.g. sinker, double head or common headed nails) as commonly used at the construction site. Accordingly, the tool 1 may be appropriately designed to accommodate a variety of nail sizes, the nailing apertures 10A & 10B are most suitably designed with sufficient aperture clearance or over sizing so as to allow the nail 9 to freely slide into and out of the nailing aperture 10. This will allow the nail 9 to freely slide out of the nailing aperture 10 after the nailed or anchored tool 1 has been removed from its anchoring site 5. Since the nailing aperture 10 may be appropriately designed to freely dislodge and unfasten the nail 9 upon removal of the anchored tool 1 from the work site, the offset string line alignment tool 1 significantly alleviates those hazardous working condition caused by offset blocks with protruding nail tips. In addition, the tool 1 significantly enhances productivity by eliminating the need to retrieve or fabricate an appropriate offset block as well as the tedious task of removing nails from the wood blocking or a batter board at the work site. The tool 1 further enhances work productivity in that in may be easily pocketed and available for use by the construction worker when needed.

Figure 6:
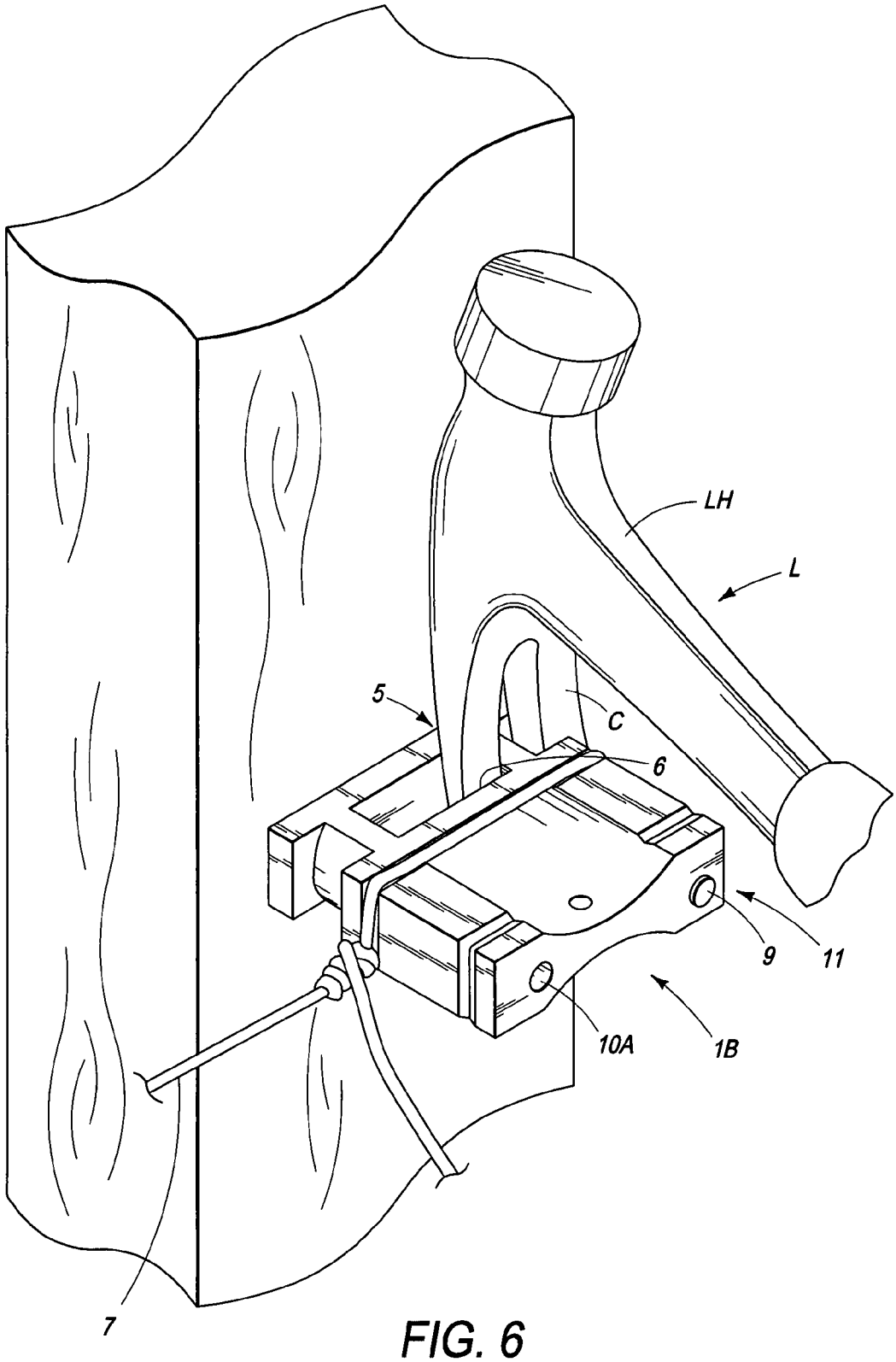
FIG. 6 is an elevated partial top view of FIG. 5 depicting the use of a claw hammer to remove the offset alignment tool from a post.
Figure 7:
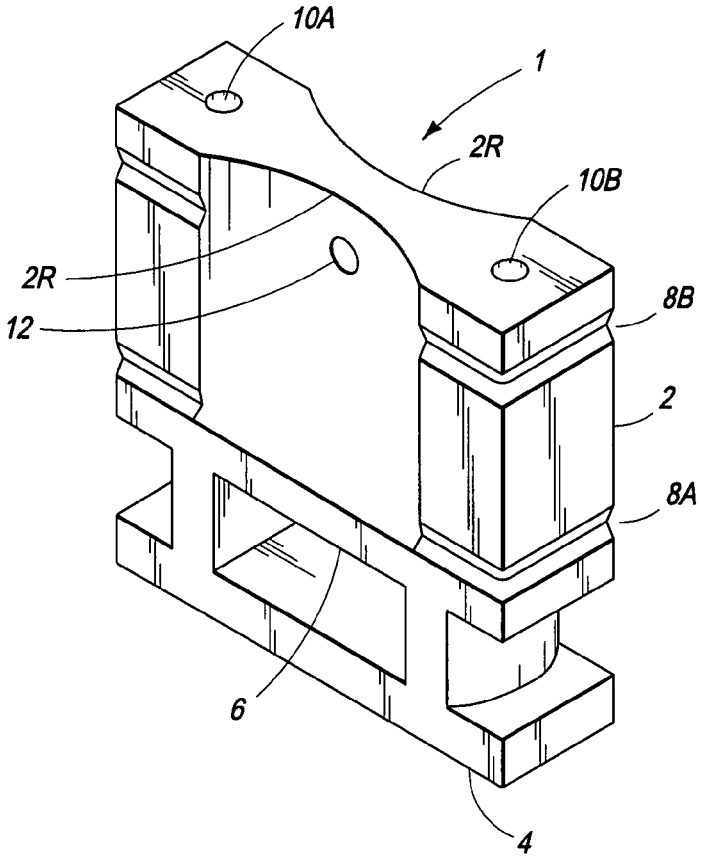
FIG. 7 is an enlarged elevational view of the offset alignment tool of this invention.

In another embodiment of the invention, the body 2 may be suitably provided with a leveraging catch 6 which allows a leveraging tool or instrument L such as a claw hammer LH as depicted in FIG. 6 to remove the anchored tool 1 from the anchoring site 5. The leveraging catch 6 may be of any appropriate design and construction which permits any type of leveraging tool or instrument L (screw driver, bar, rod, etc) to apply a leveraged force to the body 2 and biasingly remove the nailed body 2 from its offset mounting site 5.

The depicted offset line alignment tool 1 optionally includes a recessed body indentation portion 2R designed facilitate hand gripping of the tool 1 so as to assist the workmen M in the handling the tool 1. As an added feature, body eyelet 12 may be effectively utilized to anchor the tool 1 longitudinally (i.e. lying flat or flat wise) to an anchoring site 5 so as to provide a ½ inch offset using body eyelet 12 when used as a nailing aperture. The body eyelet 12 may also be used to chain, hook or otherwise secure the tool 1 to the workman's apron or belt (not shown) for convenience.

The offset line alignment tool 1 is customarily used in tandem when setting an offset line 7 as illustrated by FIGS. 5, 8 and 9A. Since the string line 7 will desirably be placed at a desired predetermined guide position at the anchoring site 5, the mounting or anchoring site 5 will necessarily be so positioned so as to provide the guide 8 with the desired offset distance (d) from the construction material mounting or nailing surface to the string line 7 such as illustrated by FIGS. 5-6, 8, 9A and 9B. FIGS. 5, 6 and 8 illustrate a ¾ inch offset (d) while FIGS. 9A and 9B show a 1½ inch offset (d). A one inch board having a nominal thickness of ¾ inch and a 2 inch board having a nominal thickness of 1½ inches may, if desired, be used as an auxiliary measuring instrument to demark the appropriate lumber or material placement from the offset string line 7 as typified in FIG. 9A. Likewise, measuring sticks, tapes, etc., may also be used to measure the desired offset distance (d) from the string line 7. Occasionally, the building structure itself fails to provide a suitable mount for the tool 1 in which case it may be necessary to erect a batter board (e.g. pole or stake) to provide the appropriate mount for the desired offset line.

Pursuant to the invention as illustrated by FIGS. 5-6 and 9A, there is also provided a method for using a pair of offset straight line alignment devices 1A & 1B to provide an offset string line 7 anchored onto the anchoring site 5 at a building construction site. As shown, each pair of the devices 1A & 1B appropriately provides a base surface 4 having a planar surface for forming a planar bearing surface for emplacement of the pair of tools 1A & 1B at the respective anchoring site 5, a body 2 equipped with at least one string guide 8 for retaining a string line 7 at a predetermined offset guide position (d) projecting upwardly from said base surface 4 and anchor securing member or means 10 for anchoring the pair of the devices 1A & 1B with an anchoring implement 9 at the anchoring site 5. Collectively, the anchor securing means 10 and the anchoring implement 9 when used conjunctively to anchor the tool 1 to the anchoring site 5 provide the anchoring means 11 for anchoring the tool 1. Using a paired set of such tools 1A & 1B, the method generally comprises:

a) anchoring a first offset string line tool (e.g. 1A) at the anchoring site 5 with the anchoring means 11 so as to position it at a desired offset guide position (d) for the offset string line 7;

b) laterally positioning and anchoring a second offset tool (e.g. 1B) at a laterally disposed anchoring site 5 with the anchoring means 11 so as to provide the desired offset guide position (d) when said offset string line is strung from said first offset tool 1A to said second offset tool 1B at the predetermined guide position;

c) stringing the offset string line 7 form a first guide 8 of the first offset tool 1A to a second guide 8 of the second offset tool 1B at the predetermined offset guide position; and d) using the string line 7 as an off-set measurement (d) for placement of construction materials to the building at the construction site.

The removal of the offset tools 1A & 1B from the construction or anchoring site 5 may be simply achieved by placing the claws C of a claw hammer LH beneath the claw catch 6 and prying the tool 1 from the mount by pulling down upon the handle of the claw hammer LH to pry the nailed offset tool 1B from its anchoring site 5 as illustrated by FIG. 6.

The offset alignment tool 1 provides a durable offset sting line tool 1 which can be effectively used and reused to establish accurate and effective offset lines in the construction of buildings. Use of the offset string line 7 in the construction of multiple storied structures provides a surprisingly accurate plumb for maintaining the necessary vertical perpendicularity between stories with straight line accuracy. The multiple guide lines 8 allows two or more commonly used offset positions to be provided by a single, easily handled and stowable offset tool 1. The durable construction, anchor securing means 10 adapted for use with anchoring means 11 commonly used construction materials at the construction site, leveraging catches 6 for levering use with common construction tools L such as a claw hammer LH permits the offset alignment tool 1 to be readily installed at the desired anchoring site 5 and removed from the anchoring site 5 without damage to the tool 1 upon extensive use. The offset line alignment tool significantly enhances the efficacy and workmanship of the workmen M at the construction site.

What is claimed is:

1. A compact offset string line alignment tool sized for pocketing by a work person and useful for providing a fixed offset line at a building construction site, said tool consisting essentially of a rigid main body having a base surface section suitable to provide a bearing surface for emplacement of the tool onto a fixed offset anchoring site at the construction site, with said rigid body projecting upwardly from the base surface section having incorporated into said rigid body at least one string guide laterally positioned from the base surface section at an offset position for retaining a string line at a predetermined offset guide position and anchor securing means within said rigid body for anchoring the rigid body with an anchoring implement at the offset anchoring site.

2. The tool according to claim 1 wherein the anchor securing means includes at least one nailing aperture retained within said body for nailing the rigid body onto construction material at the anchoring site.

3. The tool according to claim 2 wherein the rigid body consists essentially of a molded body and the molded body includes a leveraging catch incorporated onto said molded body for removing an anchored tool from the anchoring site with a leveraging instrument.

4. The tool according to claim 3 wherein the leveraging catch comprises a leveraging site for catching a claw of a claw hammer and the at least one anchor securing means comprises a pair of nailing apertures retained within said body.

5. The tool according to claim 4 wherein the body includes a pair of laterally disposed grooved guides for retaining the string line at a desired predetermined offset guide position at the construction site.

6. The tool according to claim 1 wherein the string guide is positioned upon said body so as to retain the string line at offset measurements of about ¾ inch and about 1½ inch.

7. A method for using a pair of pocket sized offset straight line alignment tools to provide an offset string line at a building construction site, with each of said pair of tools being comprised of a rigid main body having a base surface section of a substantially flat planar surface suitable to provide a bearing surface for emplacement of each of said pair onto an anchoring surface at the construction site, with said rigid body projecting upwardly from said base surface section and having rigidly affixed thereto at least one string guide laterally positioned from said base surface section at an offset position for retaining a string line at a predetermined offset guide position and anchor securing means rigidly incorporated onto said body for anchoring the respective pair of the tools at an anchoring site with an anchoring implement, said method comprising:

a) anchoring the base surface section of a first of said pair of tools at a first anchoring site with one anchoring implement so as to position the first of said pair at a desired offset guide position for stringing the offset string line;

b) laterally positioning and anchoring the base surface section of a second of said pair of tools at a second anchoring site with a second anchoring implement so as to position the second of said pair at the desired offset guide position for the stringing of said offset string line thereto;

c) stringing the offset string line from the desired offset guide position of the first of said pair to the desired offset guide position of the second of said pair; and d) using the string line as an off-set measurement site for placement of construction materials to the building at the construction site.

8. The method according to claim 7 wherein the pair of the offset straight line alignment tools respectively include a leveraging catch incorporated within said body for removing the first of said pair from the first anchoring site and the second of said pair from the second anchoring site with a leveraging instrument at the construction site, the first anchor securing means and the second anchor securing means comprise nailing apertures for nailing the pair of tools onto the first anchoring site and the second anchoring site, the anchoring implement includes nails, and the anchoring includes nailing of the first of said pair and the second of said pair with said nails at the desired predetermined offset guide position at the first anchoring site and the second anchoring site.

9. The method according to claim 8 wherein the method includes the additional steps of removing the first of said pair and the second of said pair from the first anchoring site and the second anchoring site by respectively applying a leveraging biasing force onto the leveraging catch of the first of said pair and the second of said pair with the leveraging instrument to remove the nails from the first anchoring site and said second anchoring site.

10. The method according to claim 9 wherein the leveraging instrument comprises a claw of a claw hammer and the method includes leveraging the claw against the leveraging catch so as to remove the anchoring nails from the anchoring surface.

* * * * *